United States Patent [19]

Pinto

[11] Patent Number: 4,682,388

[45] Date of Patent: Jul. 28, 1987

[54] TEXTILE FLOCK FEED CONTROL SYSTEM AND METHOD

[75] Inventor: Akiva Pinto, Gastonia, N.C.

[73] Assignee: John D. Hollingsworth on Wheels, Inc., Greenville, S.C.

[21] Appl. No.: 898,985

[22] Filed: Aug. 22, 1986

[51] Int. Cl.[4] ..... D01H 5/38; D01G 15/40

[52] U.S. Cl. ..... 19/105; 19/240; 19/300

[58] Field of Search ..... 19/64.5, 97.5, 105, 19/240, 300

[56] References Cited

U.S. PATENT DOCUMENTS

| | | | |
|---|---|---|---|
| 4,161,052 | 7/1979 | Erben | 19/105 X |
| 4,494,204 | 1/1985 | Hösel | 19/105 X |
| 4,510,647 | 4/1985 | Keller et al. | 19/105 |

*Primary Examiner*—Louis K. Rimrodt

*Attorney, Agent, or Firm*—Cort Flint

[57] ABSTRACT

A control system and method for controlling the rate (Y) of fiber input (24) into a delivery system (28) in response to sensed fiber quantity (56) is disclosed. The control system generates a step control signal (C,D) in response to first deviations about a prescribed fiber quantity condition (1 or 1,2). Deviations of small magnitude caused by various fiber delivery conditions, i.e. fiber opening, duct friction, etc., are taken into account without overreacting to the variation. In response to deviations outside the range of the first deviations, an integrated ramp signal (E, F or 128, 124) is produced which automatically seeks a new level of fiber input rate. Such deviations are normally caused by changes in system requirements such as the changing consumption and production requirements of an associated carding machine (48) to which fibers are fed from a chute feed (42).

17 Claims, 7 Drawing Figures

TEXTILE FLOCK FEED CONTROL SYSTEM AND METHOD

BACKGROUND OF THE INVENTION

The invention relates to a system and method for controlling the feeding of fiber flock to associated textile machinery in a manner in which changes in the production requirements of the machinery and fiber conditions are accounted for with minimal over or under supply of fiber.

Conventionally, fibers, particularly cotton, are opened from a bale and cleaned on machines typically called blowroom machines which open and separate the fibers for trash removal in stages. Fiber is delivered from the blowroom machines to a fine opening flock feeder and delivery system which feeds the fibers to an associated textile machine such as a card. In the card, the fibers are straightened and aligned parallel prior to being drawn off in the form of a sliver. The carded fibers can also be drawn off in the form of a non-woven fiber batt.

The flock feeder is typically connected by a pneumatic delivery system to a chute feed of the card having a vertical chute in which fibers are accumulated. In the chute feed, fibers are compressed for delivery to the card in the form of a compacted fiber batt.

The fiber flock is delivered from the flock feeder by means of a fiber-laden airflow. The fiber laden air enters the entrance of the chute feeder whereupon the fiber flock contained in the air is deposited in the shaft of the chute above a top feed roll. The top feed roll feeds the fiber flock into a formation section of the chute where the fiber flock is compressed into the fiber batt. Bottom delivery rolls convey the fiber batt to the licker end of the card. By controlling the weight of the fiber batt, a uniform sliver or non-woven fiber batt is produced by the card.

In order for the card to produce a desired output, a corresponding weight of fiber flock is supplied to the card by the chute feed in the form of fiber batt. The weight of supplied fiber flock in the batt depends on feeding conditions in the chute feed. An important feeding condition is the even distribution and level of fiber flock across the width of the chute. Even fiber distribution is a function of pressure. The pressure is determined by the quantity of fiber flock in the fiber-laden airflow coming from the air blower fed by the flock feeder in the blowroom.

There are many changing factors which influence and can cause minor deviations in the pressure of the fiber-laden airflow coming from the transport blower. First there are the conditions of the fiber flock which include degree of opening, density, resistance to the walls of the air duct, position in the duct, and temperature and humidity. These factors are constantly changing which makes control of the air pressure difficult due to the complex arrangement of the fiber flock in the airflow. Second, there may be major deviations in the pressure caused by changes in the production requirements of the card. For example, as the desired weight output of the card is varied, so must the quantity of fiber and hence pressure of the fiber-laden air if the output of the card is to be of a regular density and uniform weight.

U.S. Pat. No. 4,321,732 teaches sensing of the pressure in an air distribution conduit downstream of the blowroom transport blower. The signal representing the sensed pressure is converted into an analog signal and utilized to generate a continuous stepless electric analog signal which controls the speed of the feeding roll supplying fiber flock to the transport blower. However, the problem arises in that strict analog control of the feed roller in the proposed manner may create a condition of over supply or under supply of fiber due to the aforedescribed complex nature of the fiber-laden airflow and overresponse to changes in the factors which influence the airflow and pressure and production requirements.

U.S Pat. No. 4,535,511 teaches controlling the feed rollers of a flock feeder in response to a sensed fiber volume to prevent intermittent operation by utilizing a continuous analog control signal which gives rise to the aforesaid problems. The level of fiber flock in a chute feed is sensed as well as conditions downstream of the carding machine. The compensation of adjusting flock feed at the flock feeder in response to conditions at the end of the card are not entirely effective.

In U.S. Pat. No. 3,709,406 a desired air pressure drop is created across a fiber flock column in a chute feeder, and the pressure drop is changed in relation to deviations in the output of the card to reduce further deviations. Photocells are utilized to control the height of the fiber flock column.

Accordingly, an important object of the present invention is to control the amount of fiber flock introduced into a pneumatic delivery system in such a manner that factors which change and influence the quantity of introduced fiber are responded to without overcompensation.

Still another object of the present invention is to provide a control system and method for controlling the quantity of fiber flock introduced into a fiber delivery system in response to changes in production requirements and fiber delivery conditions in such a manner that minor transitory deviations in the sensed quantity of introduced fiber are taken into account and determined before committing the system to a permanent change in introduced fiber quantity.

Still another important object of the present invention is to provide a system and method for controlling textile fiber processing machinery that includes a pneumatic fiber delivery system into which a fiber quantity is introduced by a fiber controllable fiber input wherein the fiber input is normally controlled by an oscillating step control signal which is automatically interrupted by an integrated ramp signal when large deviations are detected which require a new input rate and minor transitory deviations are taken into account without over reaction.

SUMMARY OF THE INVENTION

The above objectives are accomplished according to the present invention by employing a two-speed control system employing a step control signal having two or more speeds to control nominal operation of a feed input, and a ramp control signal to automatically find a level of nominal operation in response to large deviations representing production changes. The multi-control system controls a fiber input such as a feed roll of a fiber flock feeder in a step-wise manner to satisfy production requirements of an associated textile machine in response to a first range of deviations cause by variations in fiber delivery conditions such as degree of fiber opening and density. Pressure is sensed in the conduit of a pneumatic delivery system which delivers the fiber flock to the associated textile machinery by means of fiber-laden transport air. The pressure of the fiber-laden air is utitized as an indication of the quantity of fiber flock introduced into the delivery system and to the associated textile machine which may be a chute feeder of a carding machine. A preset pressure is utilized as an indication of a desired fiber quantity state to satisfy production requirements of the system. Alternately, a photocell or other level detector may be employed in the chute to sense fiber level as a function of fiber quantity. Two preset pressure points may also be used. By controlling the fiber input feed roll drive, the correct quantity and pressure of fiber delivered to the chute feeder may be controlled in order that even distribution and level of the fiber flock occurs across the width of the chute feed. This contributes to a uniform weight per unit measure of the output of the card whether it be a nonwoven product or sliver. The tendency of the system to overreact to minor deviations in sensed fiber quantities caused by changes in fiber delivery conditions, which may be of a transient nature, is reduced by using a step control which oscillates between high and low volumes in the range of the minor deviations. If the deviations continue and become large, an integrated ramp control signal is produced in the same direction as the last step control signal. As soon as the fiber input device satisfies the fiber quantity state again, the step control signal is again initiated to control nominal system operation.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention relates to a control system for use in textile processing machinery in which overcorrection of the controlled quantity in response to changes in variable quantities is substantially reduced to minimize over and under supply of the supplied quantity. In particular, the invention has advantages in relation to controlling the quantity of fiber introduced into a pneumatic fiber delivery system which delivers the fiber to a chute feeder of a carding machine for production of woven or nonwoven textile material. The control system and method have as their objective the minimizing of over or under supply of the quantity of fiber introduced into the delivery system in response to major system deviations such as changes in the production requirements of the card and versus minor deviations such as changes in fiber delivery conditions which may be of transient nature.

While the proper feeding of fiber flock to the chute feeder involves and affects many stages of the textile process which, in the case of cotton begins with opening of a bale and ends with carded fibers being produced in the form of a nonwoven batt or sliver, only so much of the textile process as is necessary to an understanding of the invention is illustrated. Accordingly, blowroom machinery is illustrated as including a final fiber opening machine 10 which receives fiber at duct 12 from downstream cleaning stations and is the final and fine cleaning operation of the fiber flock before the fiber flock is introduced into the pneumatic delivery system.

Figure 1:
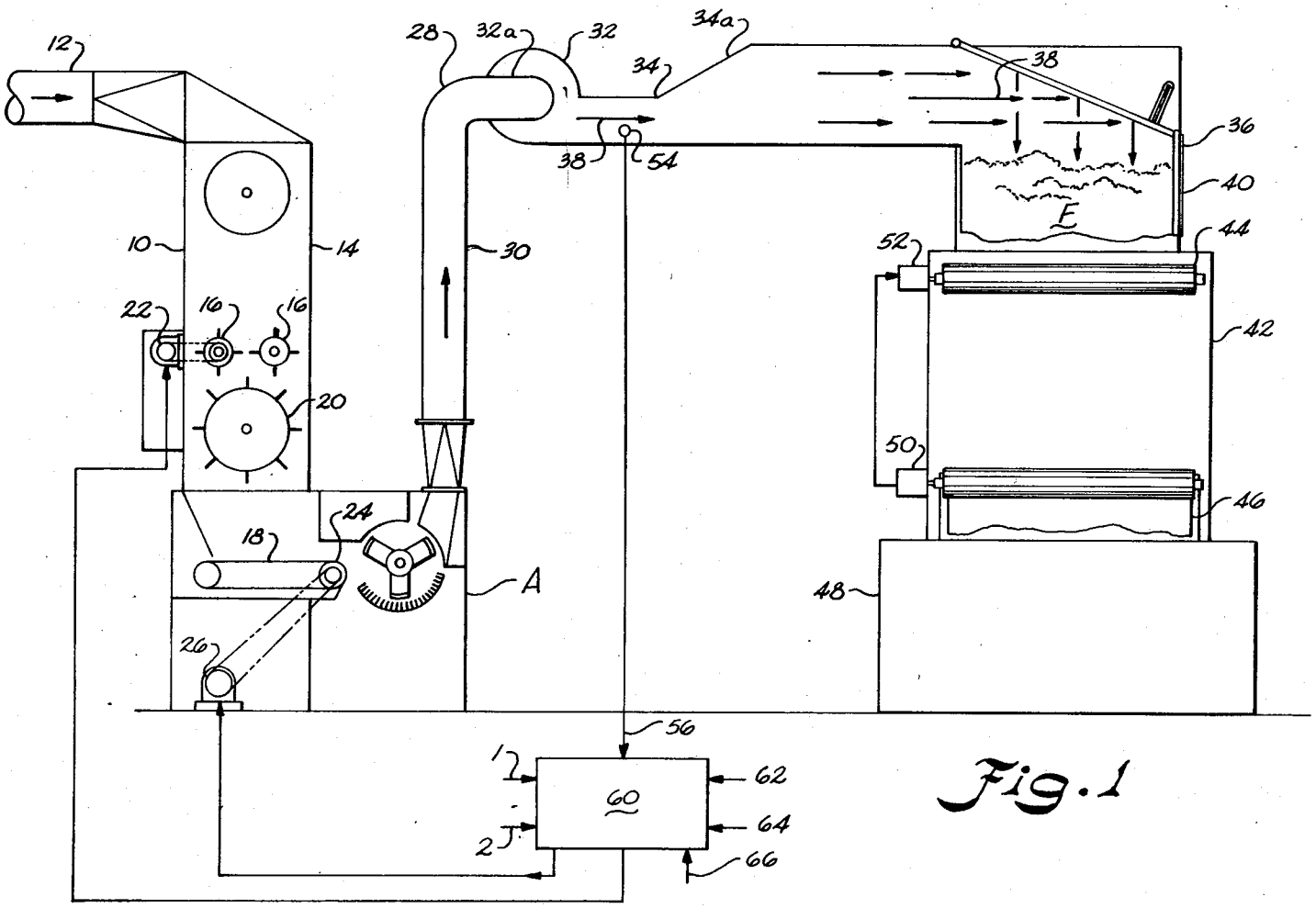
FIG. 1 is a schematic view illustrating a control system and method for controlling the fiber feed roll of a flock feeder supplying fiber flock to a chute feed of a carding machine.

Referring to FIG. 1, the flock feeder machine 10 includes a chute 14, flock feeder rolls 16 positioned in chute 14, feed fiber flock onto an apron 18 via an opening roller 20. A motorized drive means 22 is provided for controlling the speed of the feed roll 16, and hence the fiber quantity fed by the rolls to apron 18. The apron 18 is driven by apron feed roll 24 which is variably driven by an electric drive motor 26. Apron feed roll 24 determines the quantity of fiber flock introduced into pneumatic fiber delivery system 28 which includes an air conduit 30, a transport blower 32, and a delivery duct 34 having a divergent portion 34*a* which enters a top portion of a chute feeder 36. The fiber-laden air from transport blower 32 shown by arrows 38 enters a reserve section 40 of chute feeder 36 prior to being delivered to a formation section 42 of the chute feeder by a top feed roll 44 in a conventional manner.

Suction side 32*a* of transport blower 32 removes fiber flock from flock feeder 10 at the rate of which fiber is introduced into the suction side by a fibers input means in the form of an apron feed roll 24. It is to be understood, of course, that other forms of fiber input means may be utilized to introduce fiber into a pneumatic fiber delivery system such as 28. In the illustrated case, apron feed roll 24 constitutes a controllable fiber input means for introducing a desired quantity of fiber flock into the delivery system.

Chute feeder 36 produces a fiber batt 46 which consists of the fiber flock which has been opened and compacted in formation chute 42 to provide a fiber batt having a uniform density per unit measure across the width and along the length thereof. The weight of fiber batt 46 is prescribed by the demands of a carding machine 48 to which batt is delivered, all of which are conventional and well known. A signal representing the weight of fiber batt 46 is derived at 50 and delivered to chute feed roll 44 which adjusts the amount of fiber delivered and compacted in formation chute 42 to form batt 46.

Referring now in more detail to the control system and method of the instant invention as best seen in FIG. 1, means for sensing a function of the quantity of fiber is provided by a conventional pressure sensor 54 which generates a signal 56 proportional to the sensed quantity of fiber present in the air stream 38 and hence chute 40. Due to the complex nature of the air and fiber flock in fiber-laden airflow 38, it is difficult to obtain a constant reading at 54. The pressure can temporarily change in dependence on the degree of opening and density of the fiber flock. Other factors causing transient deviations which make a constant reading difficult are resistance of the fiber flock to the duct walls, the position of the fiber flock in the duct, and the temperature and humidity of the fiber flock.

Normal system changes in pressure resulting from changes in the quantity of fiber flock in the air are the conditions which it is desired to sense and which it is desired to respond to by means of changing the control signal to the fiber input means 24. The pressure at 54 is related to the rate at which the chute feed consumes the fiber flock and the production requirements of carding machine 48. Should pressure drop at 54, this would be an indication that fiber flock is being consumed such as a production change in the carding machine, and more fiber flock may need to be supplied.

An overriding concern is that the pressure at 54 of the fiber-laden transport airflow be regulated within prescribed limits so that proper pressure and level distribution of the fiber flock across the width of chute 36 and 42 occurs for production of a fiber batt 46 having a uniform weight per unit measure. In this manner, a nonwoven or woven product is produced by the card having a desired weight per unit measure.

In order to maintain the pressure of the fiber-laden air and fiber flock at 54 within prescribed limits necessary for proper chute operation, it is necessary that the minor transient deviations in the system such as occur in fiber delivery conditions be responded to in such a manner that an oversupply or undersupply of the fiber quantity is minimized.

Figures 2, 2A:
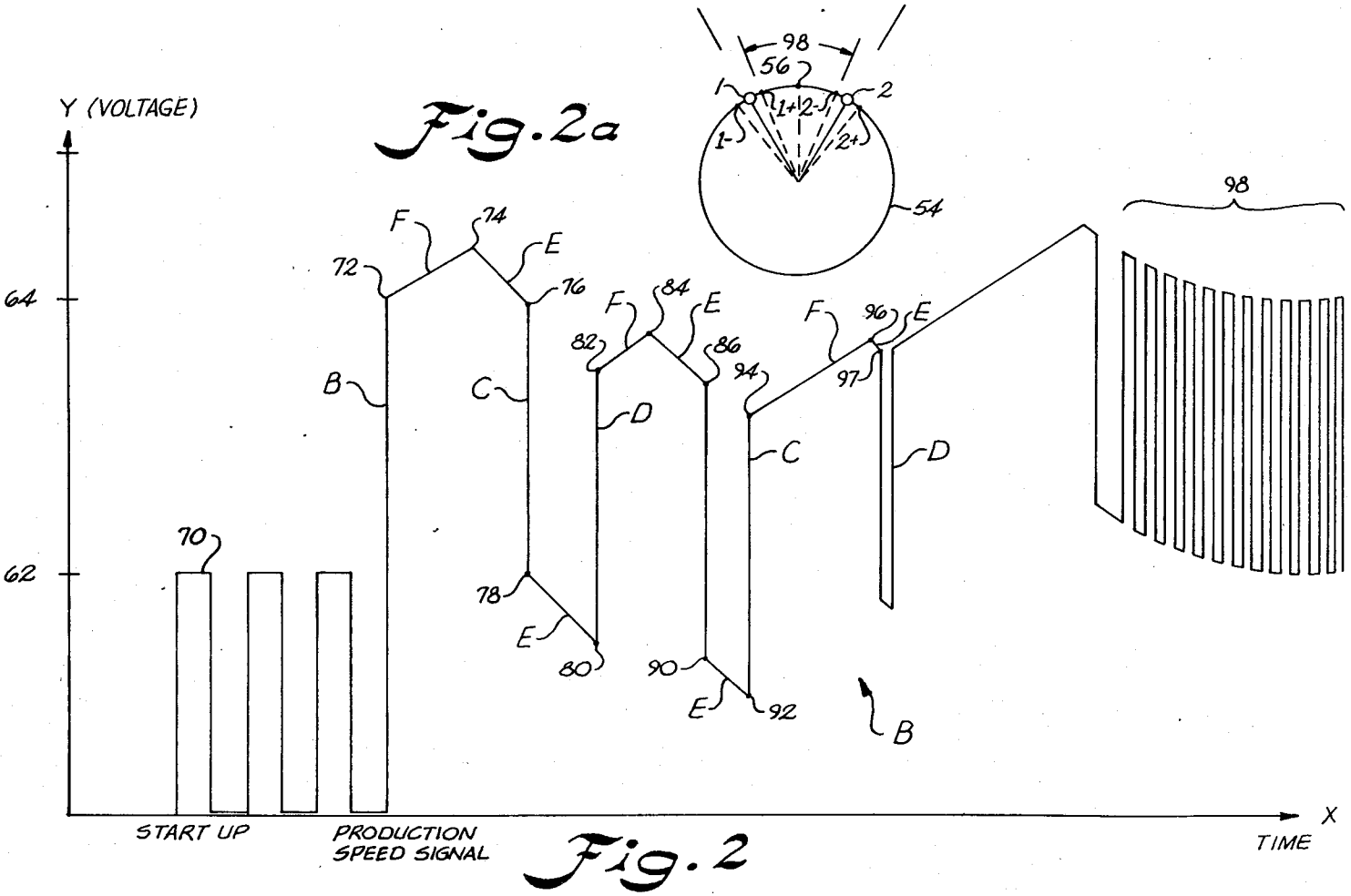
FIG. 2 is a graph illustrating the control of a feed roll of a flock feeder in a manner in which overreaction to minor deviations in fiber delivery conditions are minimized.
FIG. 2*a* is a schematic illustration of a two point reference system corresponding to a prescribed range of fiber quantity for controlling a control system according to the invention.

Referring to FIG. 2, the control system and method for controlling flock feeder 10 of pneumatic delivery system 28 can best be explained. Control of fiber input means A in response to pressure of fiber-laden air at 24 is done through a conventional process controller 60. Controller 60 employs two-step control signal C and D as long as deviations in sensed fiber quantity are minor. An integrated ramp control signal E or F is produced in response to changes in system deviations requiring that the control system operate at a new input level. The controlled quantity, which in this case is the voltage delivered to a D. C. motor 26 driving apron feed roll 24, is plotted along the Y-axis. The controlled quantity is plotted versus time shown along the X-axis. The voltage control curve represented at B is a function of the quantity of fiber sensed by pressure sensor 54. The desired fiber quantity is determined by the production requirements of the card and fiber delivery conditions as described above. Step control signals C, D are illustrated as oscillating between first and second input rates having a twenty volt difference. A multistep control signal having more than two speeds may also be utilized. It is to be understood, of course, that the two-speed control system of the instant invention can be utilized to control any controlled quantity utilized in a textile process, particularly, where it is desirable to reduce overshooting and undershooting of supplied quantities in response to system changes which may be of only a transitory nature.

Having been taught the present invention, as will be more fully set forth hereinafter, provision of a controller 60 would be well within the purview of one of average automatic programming skill.

FIG. 2*a* illustrates a readout of a pressure sensor 54 having two preset pressure values (points) 1 and 2 which may be input to controller 60 to provide a first range of deviations in pressure between in which a prescribed fiber quantity condition is provided to meet the system demands. There is a minus and plus side to each preset value which is used to illustrate and control the control system. The use of two preset values may be used since a single pressure value may be difficult to holdand account for minor deviations. When the system operates between 1+ and 2−, nominal operation of the control system exists as illustrated at 98 in FIG. 2, in which an oscillating control signal between two speed values is exhibited. Pressure signal 56 below preset value 1 indicates that the quantity of fiber introduced in to air stream 38 need be increased. Pressure signals 56 in excess of preset value 2 would indicate that the quantity of fiber introduced into the pneumatic delivery systems needs to be decreased. Thus, second, larger deviations outside the range of the first deviations produce integrated ramp signal E, F.

The second range of deviations correspond to that quantity of fiber demanded to satisfy the system caused by non-transient and large deviations in production requirements and fiber delivery condition which requires the system to find a new level of fiber input rate.

A prescribed fiber quantity state is defined by preset pressure values 1 and 2 in conduit 34, which, for example may be 2.3 and 2.5 inches of water. Two photocell levels may be used in lieu of pressure. Alternately, the first fiber quantity state may be defined by a single set point 1 which may be a single pressure or photocell indicating fiber level.

Referring now in more detail to FIGS. 2 and 2*a*, an example of the operation and method of the instant invention will be described in relation to the operation of a chute feeder and carding machine. Preset speed values representing a first high speed and second low feed roll speed are input at 62 and 64 respectively. The difference between the high and low speed values represents the instantaneous increase or decrease step signal illustrated as C and D in FIG. 2. The amplitude of the decreasing step signal is the difference between preset speed values 64 and 62. The slope of integrated ramp signal produced by controller 60 is input at 66 and may be varied between 0 and 70 DC-volts per minute in accordance with known techniques. Decreasing ramp signal E and increasing ramp signal F have the same slope but could be different in accordance with the present invention.

In operation, upon startup of the card, controller 60 outputs an intermittent fiber input control signal 70. When the production speed of the carding machine is reached, the control signal B increases until high speed signal 64 is reached at point 72. At point 72, the integrated control signal B will depend on the fiber quantity present as indicated by pressure sensor 54. As illustrated, sensed pressure signal is below preset value 1 at 72, and integrated ramp signal F is produced until point 74 is reached. At point 74, pressure signal 56 is on the 1+ side and controller 60 introduces an integrated ramp signal E which decreases. If pressure signal 56 continues to increase and preset value 2− is reached at 76, decreasing step signal C is produced which drops the speed of the fiber input rolls 24 instantaneously to that of preset low speed 62. For example, high speed preset value 64 may be 100 volts and preset low speed signal 62 may be 80 volts. Accordingly, step signal C will have an amplitude of 20 volts. At 78, pressure signal 56 is at 2+ or greater, and decreasing integrated ramp signal E is produced by controller 60. At 80, control signal steps up 20 volts indicating pressure signal 56 has reached preset 2−. Fiber quantity has decreased from point 78 to 80 while the control signal E has decreased, and step signal D gives an increase to determine if there is a real fiber quantity shortage. At 82, pressure signal is at 1− indicating a real shortage, so increasing ramp signal F is produced. The control system has full memory and remembers that fiber quantity was decreased before the increase step signal. Since pressure signal 56 further decreases after the step increase, the system knows to integrate up to seek a level of input rate that will satisfy conditions.

At 84, pressure signal 56 reaches 1+ whereupon controller 60 produces decreasing ramp E. However, pressure 56 continues to increase reaching preset 2− at 86, and decreasing step signal C is produced from 86 to 90. At 90, pressure signal 56 is at 2+ and increasing whereupon decreasing integrated ramp signal E is produced. At 92, pressure signal 56 falls to the 2− side whereupon increasing step signal C is produced raising the control signal voltage at 94. At 94, pressure signal 56 is at 1− side of preset 1 indicating further increase in fiber quantity is needed, and increasing integration ramp F is produced bringing pressure signal up to 1+ side whereupon decreasing ramp E is produced at 96. However, even with ramp E decreasing pressure, fiber buildup builds up at 97. To avoid further fiber delivery under these conditions, decreasing step signal D is produced at 97 to see if there is still a buildup of fiber and 2+ is reached. This time only a short ramp E is needed indicating the system is not too far away from preset 2 on the 2+ side. The system is close to desired operation, and finds the level after one more drop step. Generally constant voltage signal 98 consisting of oscillating signals C and D continuously integrating when the pressure signal is between 1+ and 2− is illustrated in FIGS. 2 and 2*a*. Larger deviations causing preset points 1− and 2+ to be hit again would put the system in a self-regulating mode.

In this manner the control fiber feed means A is self-regulating and done in a manner that over and under-supplying of fiber quantities in response to transient minor deviation is minimized. In two-speed operation, control signal fluctuations are limited to 20 volts under nominal conditions. When the two-speed control finds that changes are real and not transitory, the integrated ramp signal will seek to satisfy conditions in an automatic manner.

Figures 5, 5A:
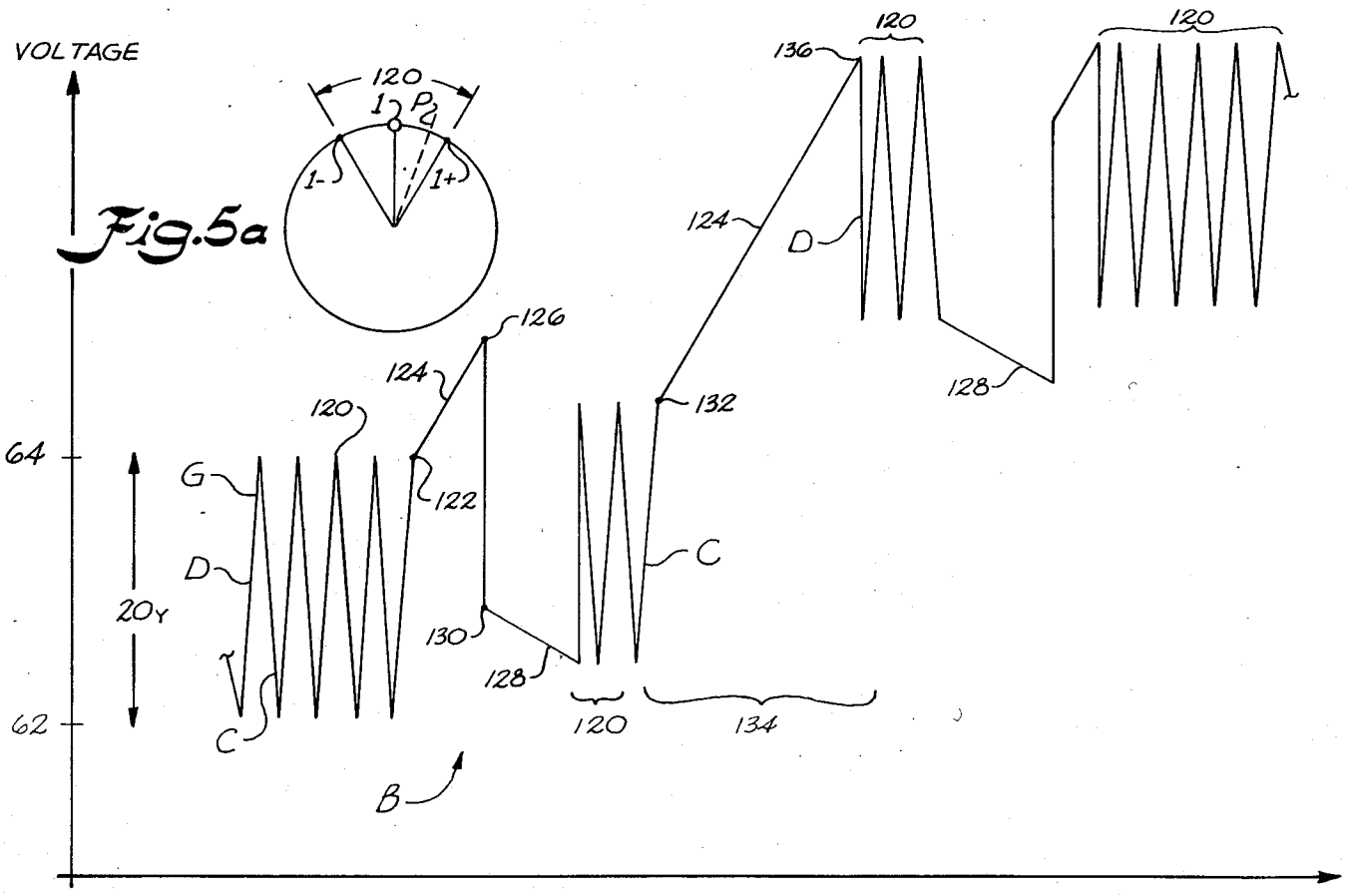
FIG. 5 is a graph illustrating a control system employing a step control signal and self-adjusting integrated ramp signal based on a single present reference point in accordance with the invention.
FIG. 5A is a schematic illustration of a single set point reference corresponding to a desired fiber quantity state for input to a control system according to the invention.

FIG. 5 illustrates the control system of the present invention operating off of a single preset value at point 1 which may be pressure or another quantity indicator. This may be preferable, for example, when operating the system off of a photocell P in chute feed 36 as a function or indication of the quantity of fibers introduced in the delivery system. In this case, control signal curve B is computed in response to variations 1+ to 1− about set point 1 corresponding to dark (covered) and light (uncovered) photocell conditions, respectively. Over portion 120, two-speed control curve EG is in a high-low performance mode in a first range of deviations of 1− to 1+ of the prescribed fiber quantity. At 122, second deviations of a larger magnitude occur and the photocell is light (1−) and ramp signal 124 is produced until dark (1+) at point 126. Decreasing integrated signal 128 is produced with a decreasing ramp since 1+ still exists at 130.

Two-speed control curve 120 is produced thereafter. Then again at 132, photocell P is light (1−) indicating need for more fiber and integration ramp 124 takes place over 134 until the two-speed control takes over at 136 when signal P is at 1− side of preset 1 (FIG. 5, 5*a*).

Two-speed voltage control signal steps up and down between high and low values in differential steps of 20 volts as long as sensed fiber quantity P is generally constant having deviations in the range about set point 1. When a nontransitory large scale deviation occurs such as a change in production requirement, P may be outside the first range. In this case, an increasing or decreasing integrated ramp signal 124 or 128 will be generated to bring the system automatically at a new level into two-speed operation depending on the needs of the system. The system may be designed such that two-speed operation will account for minor transient variations without overreacting. The step voltage control differential will again be initiated at the end of an analog ramp E or F in response to system changes.

It will be noted that step signal C or D in FIG. 5 will be repeated at the end of a previous step signal D or C when the prevailent deviation in fiber quantity signal has changed direction. An integrated ramp will be produced if the direction of the deviation continues indicating nontransient deviation and further adjustment needed. The slope of the ramp will have the same direction as the step signal from which it begins.

Figure 4:
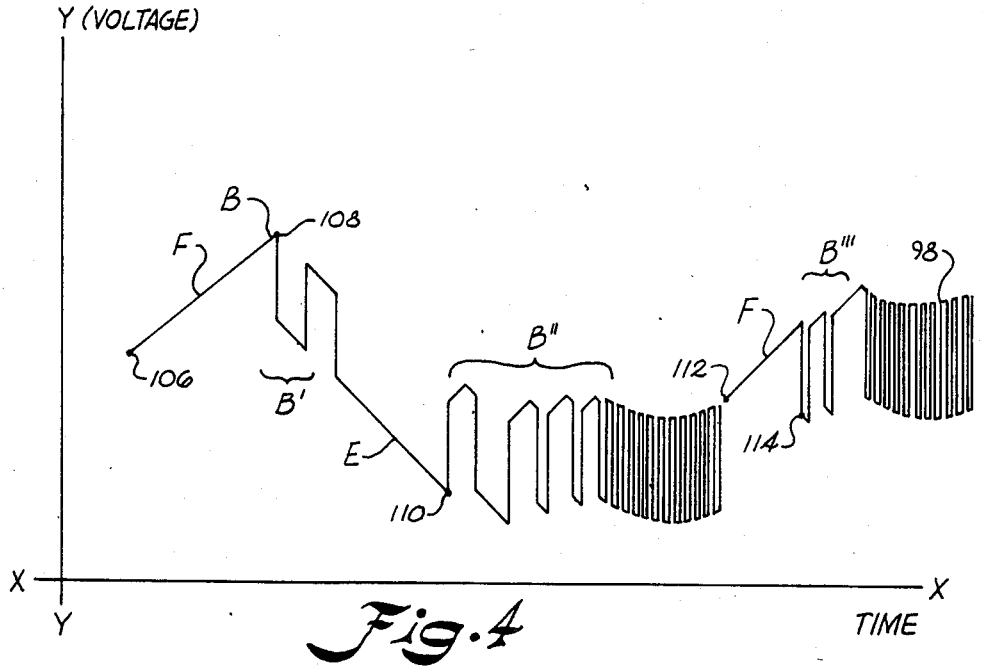
FIG. 4 is a graph illustrating the step speed control system of the present invention in automatically seeking a new input feed rate for a flock feeder feed roll in response to changing conditions.

FIG. 4 illustrates an example of the two-speed control system of the present invention as it seeks a new fiber input level in response to large scale permanent system changes and deviations in pressure P. B starts out at point 106 and increases in the integrated ramp signal F until point 108 indicating a point at which the prescribed fiber quantity state has been reached. Pressure at point 108 indicates that preset value 2 has been reached whereupon the voltage drops instantaneously by 20 volts, for example. The two-speed control curve indicated over area B′ does not sufficiently control an excess of fiber, whereupon decreasing integrated ramp signal will be produced until point 110 is reached, whereupon pressure signal 56 indicates pressure has fallen below preset value 1. Two-speed integration control again is carried out over B′ bringing the control system to a new level at which the control signal oscillates at 98 in a manner that overreaction to required fiber quantity is minimized.

Point 112 indicates a fiber quantity below 1 whereupon continuous increasing integrated ramp F is produced to find a level to satisfy requirements. Integrated ramp signal reaches F pressure beyond preset value 2 causing an instantaneous drop of 20 volts to point 114. Thereafter, two-speed control system takes over in range B‴ until the oscillating step control signal is again initiated at 98. Thus it can be seen that the integrated signal will continuously seek out an input rate to satisfy system requirements while the two-speed step control signal maintains the fiber rate of the input means at that new level in satisfying transient and minor deviations in a manner that overreaction is minimized.

Figure 3:
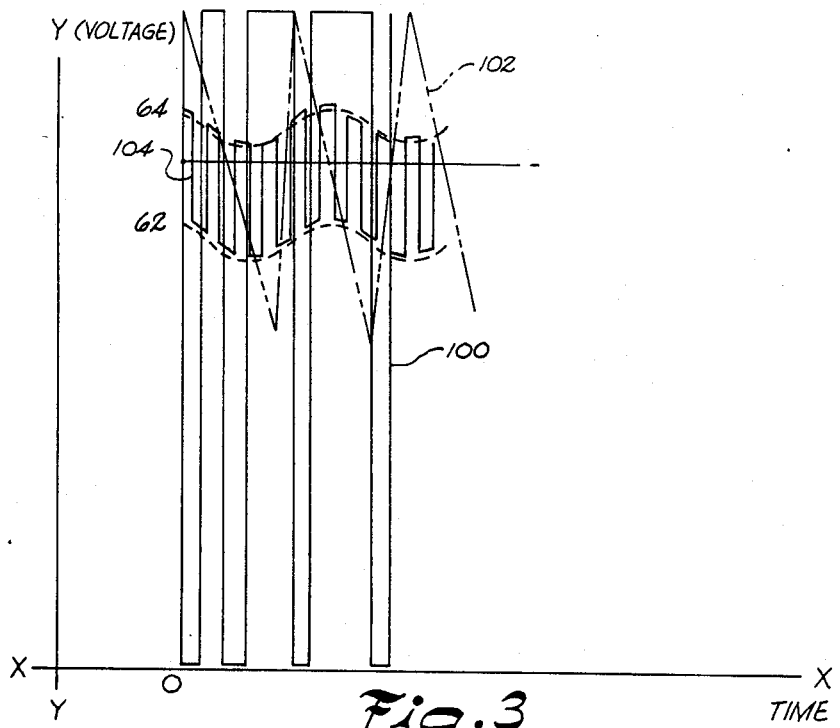
FIG. 3 is a graph illustrating a step speed control system of the present invention compared to analog control and intermittent control of a flock feeder feed roll.

Referring to FIG. 3, a graph illustrates a comparison between the two-speed control system of the present invention, an intermittent on-off control system, and a fully integrated analog control system. On-off control curve is illustrated at 100, continuous analog control signal is illustrated at 102, and step control at 104. All three curves are shown satisfying the same fiber quantity conditions in a hypothetical situation. It can clearly be seen that the over or undershooting of supply conditions caused by the on-off mode of operation and the continuous analog mode of operation exceed that of the two-speed control. This is due to the lack of the on-off mode and continuous analog mode to respond to merely transient deviations.

While a preferred embodiment of the invention has been described using specific terms, such description is for illustrative purposes only, and it is to be understood that changes and variations may be made without departing from the spirit or scope of the following claims.

What is claimed is:

1. A control system for textile processing apparatus such as carding machines and the like, said system including a textile fiber delivery means for delivering fiber in transport air to an associated textile machine, and controllable fiber input means for introducing fiber into the delivery system at a controlled rate, said control system comprising:

fiber sensing means for sensing a function of fiber quantity conditions in said fiber delivery means generating a fiber quantity signal proportional to said fiber quantity conditions;

control means receiving said fiber quantity signal and generating a control signal for controlling said fiber input means to vary the rate of fiber introduction into said fiber delivery means in a predetermined ratio to said fiber quantity conditions;

said control means generating a step control signal which oscillates stepwise generally between a first fiber input rate and a second fiber input rate in response to first deviations of said fiber quantity conditions of a first magnitude; and said control means generating a control signal which includes an integrated ramp signal having a different fiber input rate than said first and second fiber input rates in response to second deviations in said fiber quantity conditions of a second magnitude greater in magnitude than said first deviations in a manner that changes in said fiber quantity conditions requiring a nontransitory change in fiber input rate are automatically adjusted to without over-reaction to transitory or minor deviations.

2. The control system of claim 1 wherein said control means produces an integrated ramp control signal following a step control signal when sensed fiber quantity conditions deviate beyond said first magnitude of deviations and continues until a prescribed change in said deviations occurs.

3. The control system of claim 2 wherein said control means resumes generation of said step control signal when said prescribed change in said deviation occurs.

4. The control system of claim 3 wherein said prescribed change in said deviation includes a change in the direction of said deviation.

5. The control system of claim 1 wherein said first deviations include a range about a single prescribed set point.

6. The control system of claim 1 wherein said first deviations include a pair of set points corresponding to a prescr bed range of fiber quantity.

7. The control system of claim 1 wherein said control means generates a control signal which includes a combination of said ramp signal and step signal in response to said second deviations.

8. A textile process control system for controlling the quantity of textile fibers introduced into a pneumatic fiber delivery system by a fiber input means comprising:

fiber quantity sensing means for sensing a function of the quantity of fibers introduced into said delivery system and generating a fiber quantity signal proportional to said sensed function;

control means for controlling said fiber input means so that a prescribed fiber quantity is introduced into said pneumatic fiber delivery system;

said control means receiving said fiber quantity signals and generating an integrated control signal which includes an integrated ramp signal in response to fiber quantity signals having a large range of deviations from said prescribed fiber quantity; and generating a step control signal which oscillates between first and second fiber input rates when said fiber quantity signal is within a small range of deviations of said prescribed fiber quantity less than said large range of deviations in a manner that transient variations in said prescribed fiber quantity are compensated for with minimal over-reaction to the desired quantity of fiber needed to be supplied.

9. A method of controlling the rate of textile fiber input into a textile fiber delivery system in response to a sensed fiber quantity present at a point in said fiber delivery system in a manner that a prescribed fiber quantity is maintained in said fiber delivery system wherein said method comprises varying the fiber input rate as a function of a step control signal which oscillates between prescribed first and second input rates in response to said sensed fiber quantity being within a first range of deviations in said prescribed fiber quantity and varying the fiber input rate as a function of an integrated ramp control signal when said sensed fiber quantity is outside of said first range of deviations in a manner that a new level of fiber input rate is automatically established by said integrated ramp control signal at which said sensed fiber quantity is once again within said first range of deviations whereat said fiber input rate is once again varied as said oscillating step control signal.

10. The method of claim 9 including controlling the rate of fiber input by setting said prescribed fiber quantity as a single set value about which said first range of deviations occurs.

11. The method of claim 9 including controlling said fiber input rate by setting said prescribed fiber quantity as a pair of set values between which said first range of deviations occurs.

12. In a textile process, a method of controlling an input means having a variable rate which inputs a quantity of media into a textile process in a manner that a desired quantity of media is maintained in the process wherein the method comprises utilizing a step control signal to control the media input means which oscillates in a step-wise manner between prescribed first and second input rates and is generated in response to first deviations in sensed media input quantity to minimize over-reaction to first deviations in said desired preset quantity and utilizing an integrated ramp control signal to control the input means in response to second deviations in said sensed media input quantity greater than said first deviations.

13. In a textile process, a method of controlling a fiber input means for introducing a prescribed quantity of fiber into a fiber delivery system comprising controlling said fiber input means between first and second input rates in response to first deviations in said prescribed quantity of fiber introduced into said delivery system; and controlling said fiber input means with a control signal which includes an integrated ramp signal in response to second deviations in said prescribed quantity of fiber introduced into said delivery system until the quantity of fiber is brought within the level of said first deviations.

14. The method of claim 13 including determining said quantity of fiber existing in said delivery system by sensing the pressure of a fiber-laden airflow transporting said fiber in said delivery system and sensing said first and second deviations by sensing variations in said pressure.

15. The method of claim 14 wherein said first deviations include a range between a pair of prescribed pressure values corresponding to said prescribed fiber quantity introduced into said delivery system.

16. The method of claim 15 including terminating said step control signals and producing said integrated control signal when said sensed pressure reaches one of prescribed pressure values.

17. The method of claim 13 including controlling said fiber input means with combination of ramp and step control signals in response to said second deviations.

* * * * *